United States Patent [19]

Uchimi et al.

[11] Patent Number: 5,060,614

[45] Date of Patent: Oct. 29, 1991

[54] IGNITION TIMING CONTROL SYSTEM FOR AN ENGINE HAVING BACKUP FUNCTION FOR FAILURE

[75] Inventors: Kazuhiro Uchimi; Shoji Sasaki; Kenji Tabuchi, all of Katsuta; Noboru Sugiura, Mito, all of Japan

[73] Assignee: Hitachi, Ltd., Tokyo, Japan

[21] Appl. No.: 507,030

[22] Filed: Apr. 10, 1990

[30] Foreign Application Priority Data

Apr. 14, 1989 [JP] Japan ..... 1-092870

[51] Int. Cl.[5] ..... F02P 7/077

[52] U.S. Cl. ..... 123/414; 123/612; 123/630; 123/643

[58] Field of Search ..... 123/414, 612, 630, 643, 123/479, 640

[56] References Cited

U.S. PATENT DOCUMENTS

| | | | |
|---|---|---|---|
| 4,757,798 | 7/1988 | Sasaki | 123/630 |
| 4,773,381 | 9/1988 | Koshida | 123/630 |
| 4,941,445 | 7/1990 | Deutsch | 123/630 |

FOREIGN PATENT DOCUMENTS

| | | | |
|---|---|---|---|
| 62-651 | 1/1987 | Japan | 123/414 |
| 62-38851 | 2/1987 | Japan | 123/414 |
| 62-225770 | 10/1987 | Japan . | |

*Primary Examiner*—Andrew M. Dolinar

*Attorney, Agent, or Firm*—Antonelli, Terry, Stout & Kraus

[57] ABSTRACT

An ignition timing control system for an engine provides a counter-measure for an abnormal condition of a signal. The ignition timing control system has a first signal generator for generating a first signal at intervals of a predetermined crank angle while an engine is rotated n times (n is an arbitrary positive number), this first signal including a marked signal designating a particular cylinder each time the engine is rotated n times; a second signal generator for generating a second signal having pulses in a number equal to that of all cylinders of the engine at intervals of substantially an equal crank angle in synchronism with the first signal, this second signal including a signal of a form which is distinguishable from other second signal and which occurs in synchronism with the marked signal; a unit for producing an ignition signal in response to the first signal; a distributor for receiving the ignition signal and distributing the ignition signal in response to the marked signal of the first signal to each cylinder in a predetermined ignition order; a unit for detecting an abnormal condition of the first signal; and a unit for distributing the ignition signal to each cylinder in a predetermined ignition order in response to the signal synchronized with the marked signal of the second signal in place of the marked signal when the abnormal condition of the first signal is detected.

14 Claims, 8 Drawing Sheets

IGNITION TIMING CONTROL SYSTEM FOR AN ENGINE HAVING BACKUP FUNCTION FOR FAILURE

BACKGROUND OF THE INVENTION

This invention relates to ignition timing control systems and particularly to an ignition timing control system having an electronic distributor.

The ignition timing is generally determined by the load and the engine speed. The ignition timing is calculated from the output of the detector for the intake air flow representing the value of the load and from the output of the crank angle sensor associated with the engine speed, and an ignition signal is produced by triggering the output of a DRef signal (which occurs the cylinder-count times each time the engine rotates twice) produced each time each cylinder reaches a predetermined crank angle, thereby controlling the ignition in each cylinder. When a previously specified cylinder reaches a certain crank angle position, a CPU within the ignition control system generates a Mark-A marked signal for specifying a cylinder to be ignited. When the Mark-A marked signal is determined, the order of cylinders to be ignited next is naturally determined. The electronic distributor responds to the Mark-A marked signal to supply an ignition signal to the ignitor of the cylinder specified by that signal, and a next ignition signal to the ignitor of another cylinder in a predetermined order.

Therefore, the ignition timing control system has a sensor provided to produce a signal (Mark-signal produced at intervals of a predetermined angle each time the engine rotates twice) when the engine reaches a crank angle at which a particular cylinder is in a predetermined piston position. The Mark-A signal is supplied to the electronic distributor on the basis of this Mark signal.

However, if the Mark signal is not produced due to the failure of the sensor, the ignition signal can not be normally distributed to each cylinder when the output of the reference cylinder signal Mark-A becomes abnormal.

Thus, as is disclosed in the Japanese Patent Application Gazette No. JP-A-62-225770 filed by Hitachi, Ltd. on Mar. 28 in 1986, signal generating means for backup is used. In other words, when the Mark signal is detected to be abnormal, the output signal from the backup signal generator is used in place of the Mark signal so that an ignition signal is generated and distributed to each cylinder.

This prior art requires additional signal generating means for backup of the main sensor in case of the abnormal state of the Mark signal, thus increasing the cost of the whole ignition timing control system.

SUMMARY OF THE INVENTION

Accordingly, it is an object of the invention to provide an ignition timing control system capable of ignition control even when the Mark signal is abnormal, without requiring an additional signal generating means for backup.

This object can be achieved by providing first signal generating means for generating a first signal at intervals of a predetermined crank angle during the time in which the engine rotates n times (n is an arbitrary positive number), second signal generating means for generating a second signal at intervals of substantially equal angle corresponding to the number of cylinders during the time in which the engine rotates n times, in which case at least one of these signals can be specified as compared with the other signals, and means for distributing an ignition signal to the ignitors on the basis of the second signal generating means in place of the first signal generating means when the abnormal state of the first signal generating means is detected.

Therefore, even if the first signal generating means for generating a signal at intervals of a predetermined angle each time the engine rotates n times becomes abnormal, the second signal generating means generates signals the number of which equals that of the cylinders at intervals of substantially equal angle in synchronism with the first signal, during the time in which the engine rotates n times so that the reference cylinder can be discriminated. Thus, ignition control can be performed when the sensor is abnormal, without adding a new signal generating means for backup.

DESCRIPTION OF THE PREFERRED EMBODIMENTS

Figure 1:
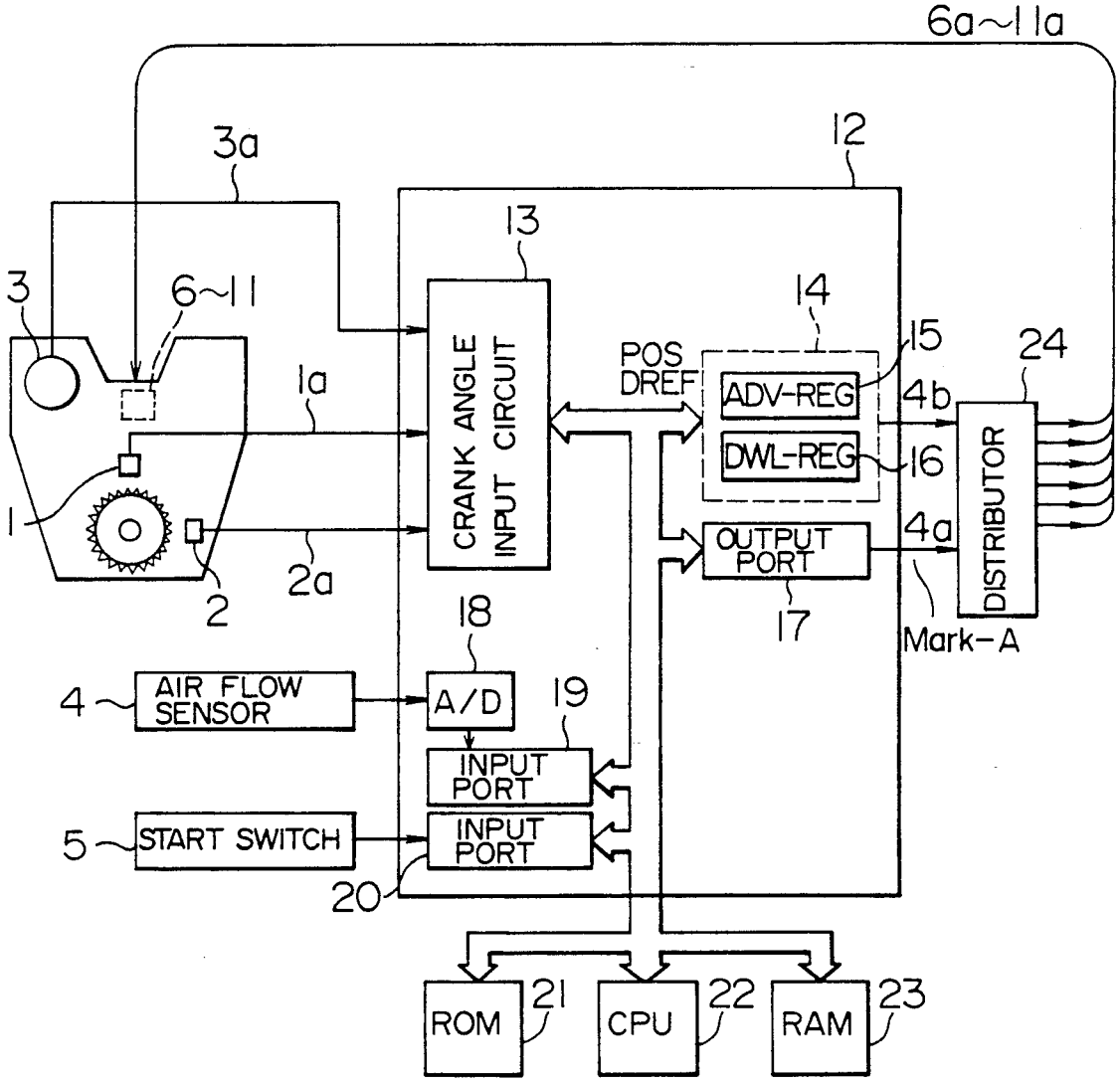
FIG. 1 is a block diagram of one embodiment of an ignition timing control system.

One embodiment of this invention (4-cycle/6-cylinder engine) will be described. FIG. 1 is a block diagram of the system. Referring to FIG. 1, the engine has different rotation sensors provided for detecting the rotating state. A reference position sensor 1 and an angle sensor 2 are provided on the crank shaft of the engine. The reference position sensor 1 produces a reference position signal Ref, 1*a* each time each cylinder arrives at a reference position, while the crank angle sensor 2 produces an angle signal Pos, 2*a* each time the crank shaft is rotated by a predetermined angle (for example, every two degrees). A cylinder discrimination sensor 3 is provided on a cam shaft which rotates in synchronism with the crank shaft. The cylinder discrimination sensor 3 produces a cylinder discrimination signal Mark 3*a*. When each cylinder reaches a particular position (when the crank angle is a particular value), a narrow pulse is produced, and when the reference cylinder reaches a particular piston position (a particular crank angle), a wide pulse, Mark-A is produced.

The output of each rotation sensor is shaped in its waveform by a crank angle input circuit 13. The intake air flow to the engine is detected by an air flow sensor 4, converted into a digital form by an A/D converter 18, and supplied to an input port 19. The state in which the engine starts is detected by a start switch 5, and supplied to an input port 20.

A CPU 22 receives the output state from each sensor, makes a calculation for ignition timing control in accordance with the program information stored in a ROM 21, and supplies an ignition timing value ADV and a duration DWL of current to ignitor for an a control circuit 14, setting them in an advance register ADV- REG and a dwell register DWL-REG. The program information is a map table of the optimum ADV value for the load and engine speed, and a map table of the DWL value for the engine speed. The CPU also supplies the reference cylinder signal Mark-A to an output port 17. The temporary data for use in the calculating operation of the CPU 22 is held in a RAM 23. The control circuit 14 produces an ignition signal on the basis of the calculation result from the CPU.

An electronic distributor 24 is responsive to the outputs from the control circuit 14 and output port 17 to distribute ignition signals 6*a* to 11*a* to ignitors 6 to 11 which are provided in the respective cylinders.

Figure 2:
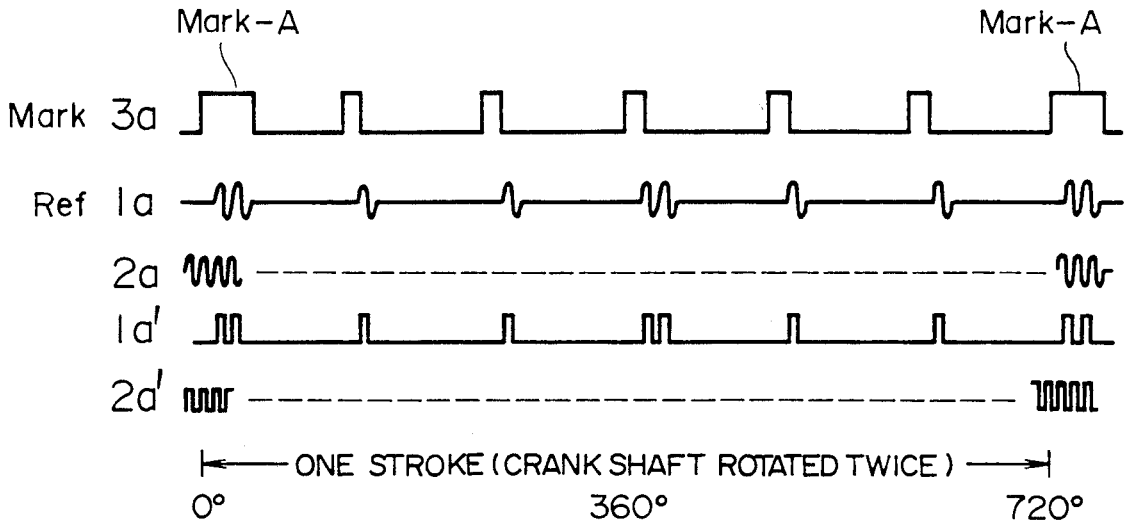
FIG. 2 is a timing chart showing the output of each rotational-position sensor.

FIG. 2 is a timing chart showing the output state of each rotation sensor. In FIG. 2, 1*a*' and 2*a*' indicate waveforms into which the reference position signal Ref 1*a* and angle signal Pos 2*a* are waveform-shaped by the circuit 13. The reference position signal Ref 1*a* is produced at intervals of substantially equal angle corresponding to the number of cylinders each time the crank shaft is rotated twice. This train of pulses also includes two continuous pulses occurring each time the crank shaft rotates once. The cylinder discrimination signal Mark 3*a* includes pulses at intervals of equal angle corresponding to the number of cylinders each time the crank shaft is rotated twice, and in these pulses, wide pulses Mark-A are included which are different rom the other pulses, and which indicate the reference position of the reference cylinder. The reference position signal Ref 1*a* and the cylinder discrimination signal Mark 3*a* are produced in synchronism with each other as shown in FIG. 2. When the wide cylinder discrimination signal Mark-A is produced, the reference position signal Ref 1*a* is two continuous pulses.

Figure 3:
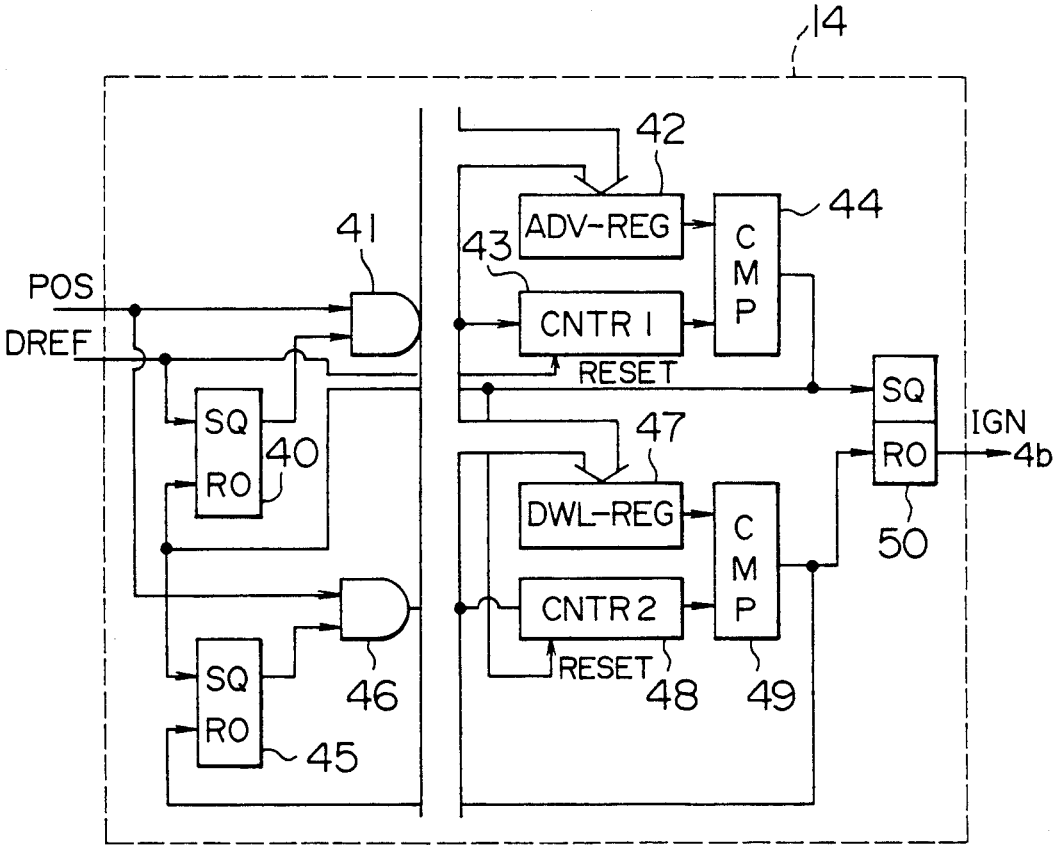
FIG. 3 is a block diagram of the control circuit.

FIG. 3 shows the details of the control circuit 14. The angle signal Pos 2*a* is supplied to AND circuits 41 and 46. A short output pulse DREF produced from a flip-flop (not shown) as a result of triggering at the leading edge of the cylinder discrimination signal Mark 3*a* is supplied to the reset terminal of a first counter 43 and the set terminal of an RS flip-flop 40, of the control circuit shown in FIG. 3, so that it is used for counting. The first counter 43 starts counting the angle signal Pos 2*a* in response to the leading edge of the pulse DREF and on the basis of the AND circuit 41 and the RS flip-flop 40, and supplies the count to a comparator 44. The comparator 44 compares the count output of the first counter and the content of an advance register 42. When the two inputs to the comparator are coincident, the comparator supplies a set pulse to an RS flip-flop 50, and resets the RS flip-flop 40. When the set pulse is supplied to the RS flip-flop 50, the ignition signal IGN becomes high level.

A second counter 48 starts counting the angle signal Pos 2*a* fed through the AND circuit 46 in response to the set pulse which is fed from the comparator 44 to set an RS flip-flop 45, and supplies the count to a comparator 49. The comparator 49 compares this count and the content of a dwell register 47. When the two inputs to the comparator are coincident, the comparator produces a reset pulse to the RS flip-flop 50, and resets the RS flip-flop 45. When the RS flip-flop 50 is reset, the ignition signal IGN becomes low level.

Figure 4:
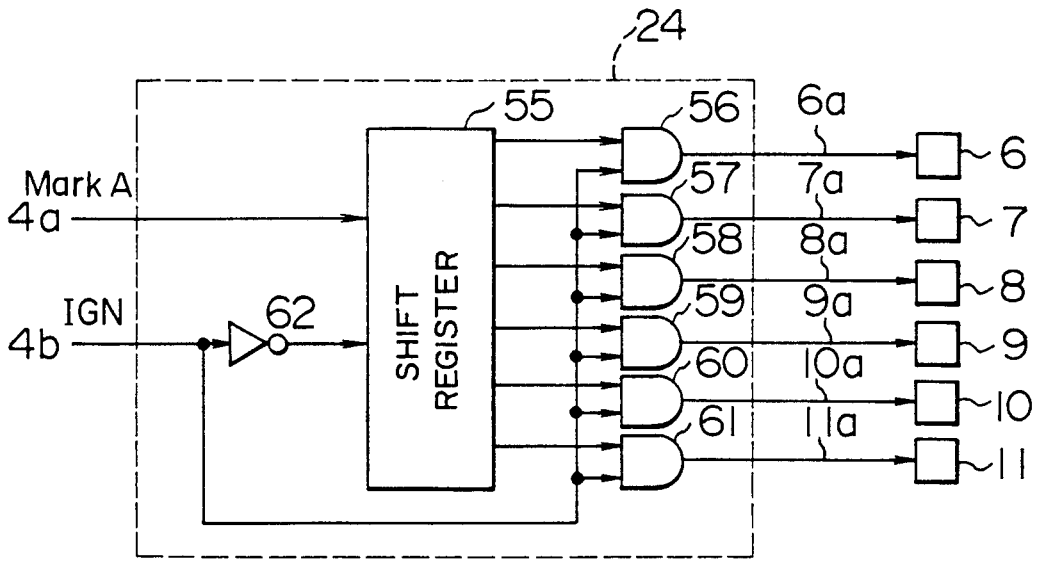
FIG. 4 is a diagram of the electronic distributor.

FIG. 4 shows the details of the electronic distributor 24. The electronic distributor 24 is formed of a shift register 55, AND gates 56 to 61 associated with the cylinders in igniting order, and an inverter 62.

Figure 5A:
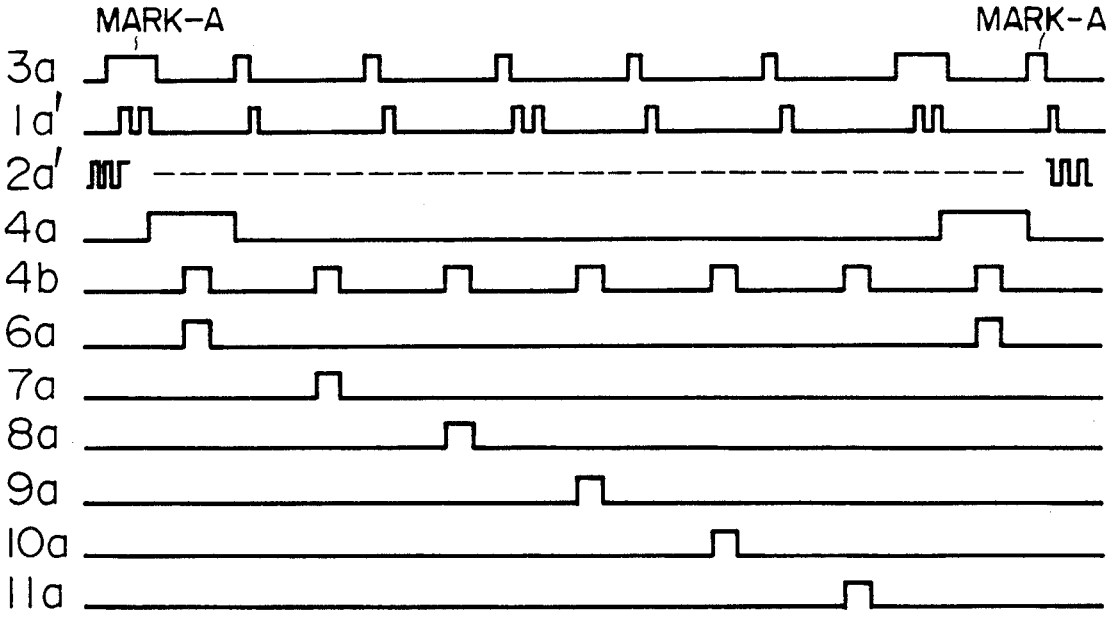
FIGS. 5A and 5B are timing charts of the reference cylinder signal output.
Figure 5B:
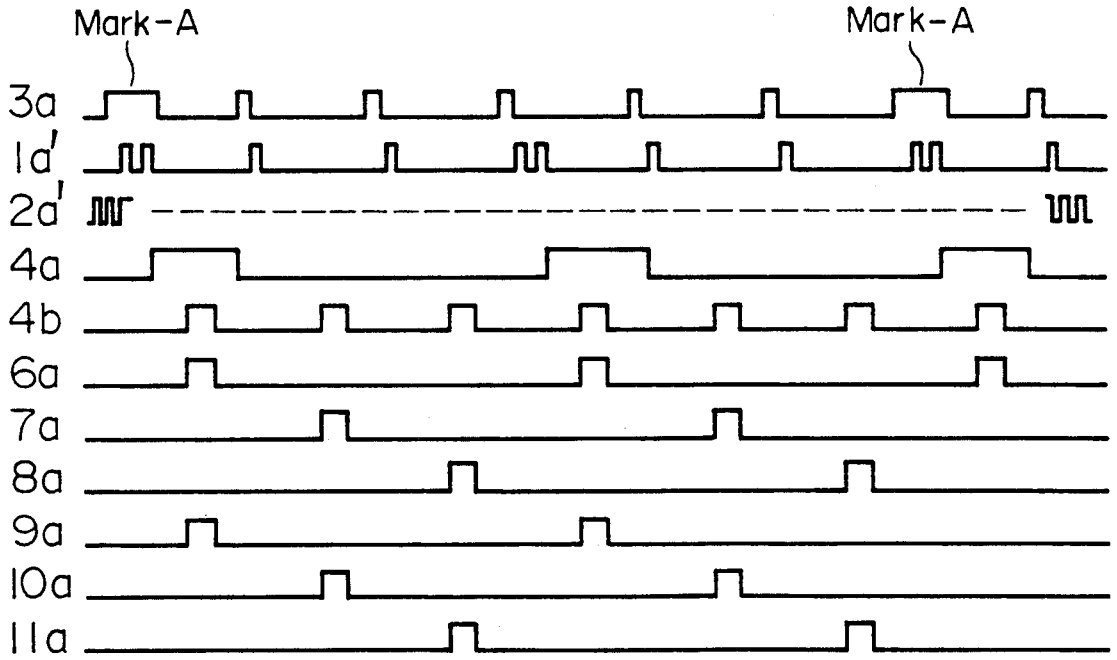

FIG. 5A and FIG. 5B are flowcharts for the operation of the electronic distributor 24. Reference is first made to FIG. 5A, and reference to FIG. 5B is made in the later description of the flowchart of FIG. 10. When the reference cylinder marked signal Mark-A (4*a*) is supplied to the shift register, the AND gate 56 associated with the first ignition cylinder (hereinafter, referred to as the first cylinder) is supplied with a high-level output. To the AND gate 56 are supplied the output signal from the shift register 55 and the ignition signal IGN 4*b*. Thus, the ignition signal IGN 4*b* is distributed to the ignitor 6 of the first cylinder.

When the ignition signal IGN 4*b* is low level, the trailing edge as the triggering level is supplied through the inverter 62 to the shift register 55. Thus, the shift register 55 shifts the high-level signal. In other words, the shift register supplies a low-level signal to the AND gate 56 associated with the first cylinder, and a high-level signal to the AND gate 57 associated with the next ignited cylinder (hereinafter, referred to as the second cylinder). Thus, the ignition signal 7*a* supplied to the other end of the AND gate is distributed to the ignitor 7 of the second cylinder. When the ignition signal is low, the trailing edge as the triggering level makes the output of the shift register shift. Thus, the electronic distributor distributes the ignition signal 4*b* to the respective cylinders in the order of igniting.

The operation of the CPU 22 will be described with reference to the flowchart.

Figure 6:
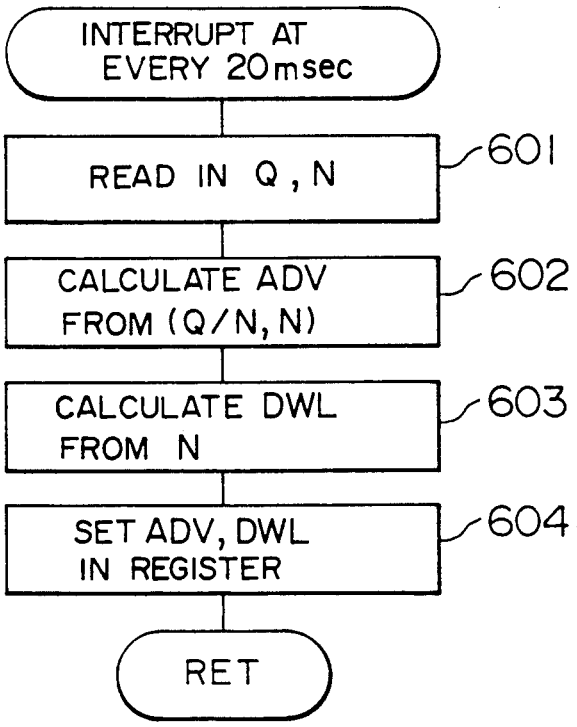
FIGS. 6 to 10 are flowcharts for the operation of the CPU.

FIG. 6 is the flowchart for calculating the ignition timing value ADV and the current flowing time DWL. The operation shown in the flowchart is started every 20 msec. At step 601, the present intake air flow Q and the engine speed N are read from the register in which these values are stored. At step 602, the ignition timing value ADV is calculated from the intake air flow per unit revolution, Q/N and the engine speed. This calculation is made by reading the related values from the three-dimensional ignition timing map. At step 603, the current-flowing time DWL is calculated from the engine revolution rate N. This calculation is made by reading the related values from the three-dimensional current flowing time map. Step 604, the ignition timing value ADV and the current-flowing time DWL are set in the ADV register 14 and DWL register 16 of the control circuit 14, and then the program ends.

Figure 7:
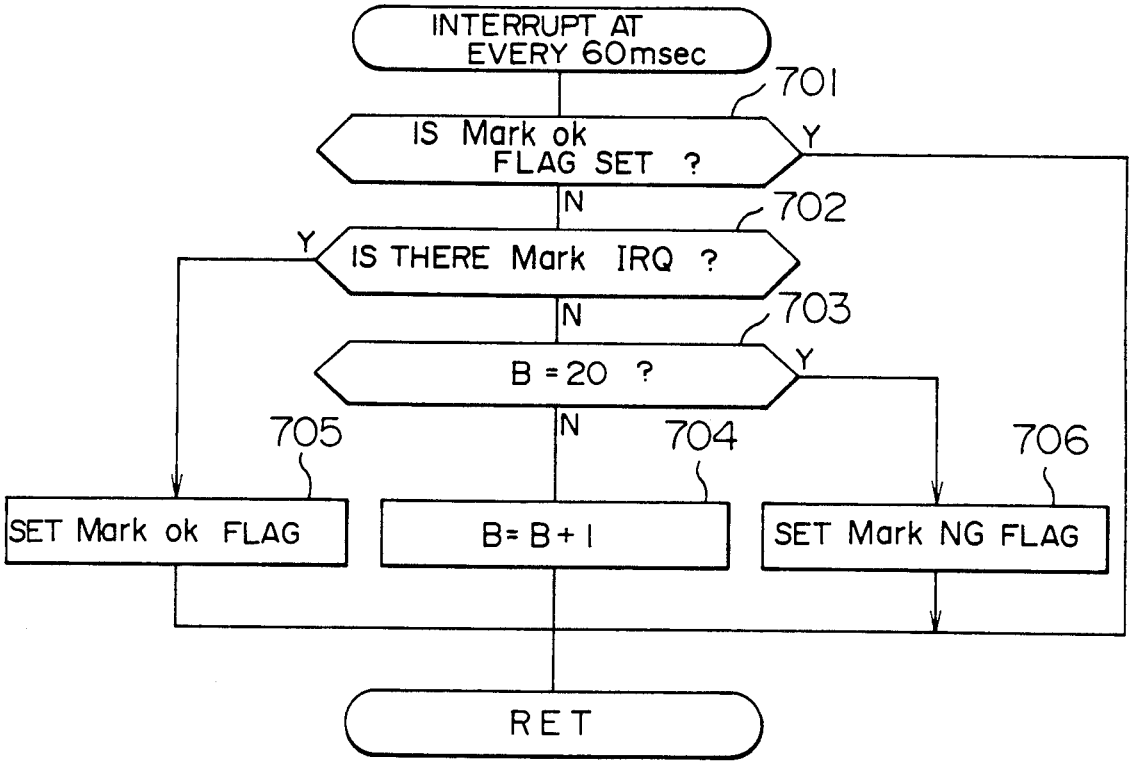

FIG. 7 is a flowchart showing the operation for deciding if the output of the cylinder discrimination sensor 3 is abnormal. The discrimination between the abnormal and normal conditions of the output of the cylinder discrimination sensor 3 is made on the basis of the fact that the output pulse is present or absent in a certain time (count). When in this flow operation the cylinder discrimination sensor 3 is determined to be abnormal, the program goes to the backup flow operation shown in FIG. 10 in order to continue the ignition control. The abnormal condition discriminating operation shown in the flowchart of FIG. 7 is started every 60 msec. At step 701, a decision is made as to whether the Mark ok flag is set or not. This Mark ok flag indicates that the output of the cylinder discrimination sensor 3 is normal. Thus, if the flag is set, it has already been determined that the sensor 3 is normal and so further processing is not necessary, and hence this flow ends.

At step 701, if the Mark ok flag is not set, to determine if the cylinder decision signal Mark 3*a* is not normal, the next step for the decision of whether the cylinder discrimination sensor is abnormal is executed. At step 702, decision is made as to whether the Mark IRQ is present. The Mark IRQ signal specifies that an interrupt processing is inserted in the operation of the CPU as the Mark signal 3*a* is generated. The presence of the Mark IRQ signal means that the cylinder discrimination signal 3*a* is already being produced. Since the cylinder decision signal Mark 3*a* is normally produced, the cylinder discrimination sensor 3 is decided to be normal. If the cylinder decision sensor 3 is normal, at step 705 the Mark ok flag is set, and the flow ends.

When at step 702, if the Mark IRQ is not produced, at step 703 decision is made of whether the count B has reached 20. The count B is stored in the count area set in the RAM 23. When the ignition key is turned on, or when resetting is made at the time of starting the microcomputer, the count B is 0. As indicated at step 704, the count B is increased by one at every sequence of the flow in FIG. 7. If at step 703 the count B is 20, it means that the cylinder discrimination signal Mark 3*a* has not been produced for 1.3 seconds (60 msec×20) after the start of the engine. This situation indicates that the sensor 3 is abnormal. When at step 703 the count B reaches 20, the cylinder decision sensor 3 is decided to be abnormal. At step 706, the Mark NG flag indicating that the cylinder discrimination sensor is abnormal is set, and this flow ends. If at step 703 the count B is not 20, the count B is incremented by one for continuously monitoring that the cylinder discrimination signal is produced, and this flow ends. The count B is not limited to 20, but can be arbitrarily set depending on the type and specification of the engine.

Figure 8:
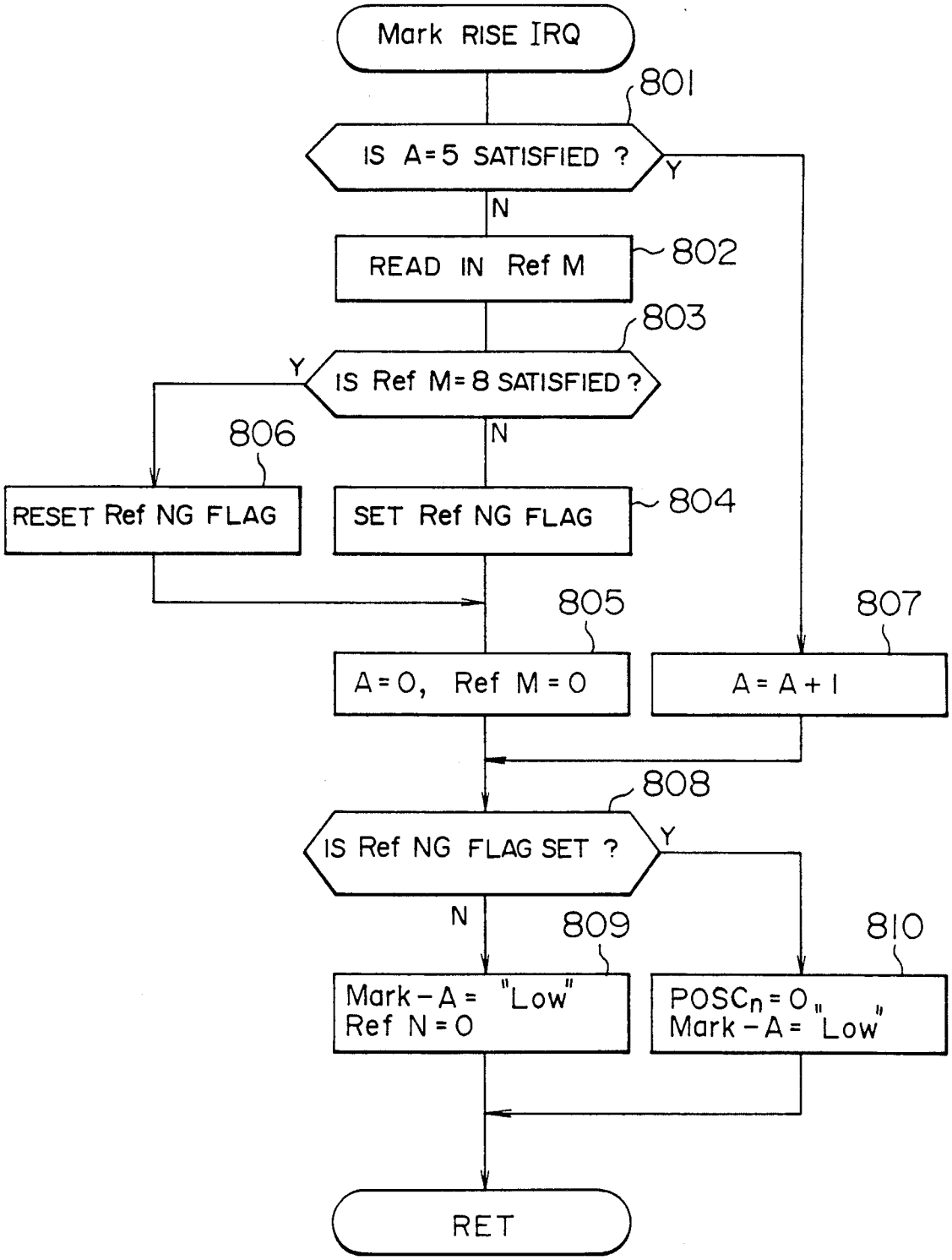

FIG. 8 is a flowchart showing the operation of the decision of whether the reference position signal Ref 1*a* is abnormal and showing the preparatory operation for the output of the reference cylinder marked signal Mark A on line 4*a* to the distributor 24. The abnormal condition or normal state of the reference position signal Ref 1*a* is decided from the fact that a predetermined number of, (8), Ref pulses occurred or not when the engine rotated twice. The operation shown by this flowchart is started by triggering at the leading edge of the cylinder decision signal Mark 3*a*.

At step 801, decision is made of whether the count A is 5 or not. This count A is incremented by one each time this flow is started as shown at step 807. The count A is stored in the count area set in the RAM 23. At step 801, decision is made of whether the cylinder discrimination signal Mark 3*a* is produced six times. As shown in the timing chart of FIG. 2, the cylinder discrimination signal Mark 3*a* is produced six times each time the crank shaft is rotated twice. In other words, at step 801 decision is made of whether the crank shaft is rotated twice.

If at step 801 the count A is 5, the count A is incremented by one for the output of the next cylinder discrimination signal Mark, and the program advances to step 808 for the next processing. If the count A is not 5, at step 802 the count RefM is read in from a certain register of the RAM 23. The count RefM is incremented by one each time the reference position signal Ref 1*a* is produced as will be described later. This count is also reset at step 805 as described later. In other words, the count RefM indicates the number of output pulses of the reference position signal Ref 1*a* occurring during the time in which the crank shaft is rotated twice.

At step 803, decision is made of whether the count RefM is 8, or whether the number of output pulses of the reference position signal Ref 1*a* occurring during the time in which the crank shaft is rotated twice is 8. As shown in the timing chart of FIG. 2, if the output of the reference position sensor 1 is normal, the number of pulses occurring during the time in which the crank shaft is rotated twice is 8. Therefore, if the count RefM is 8, the reference position sensor 1 is normal, and at step 806 the RefNG flag is reset. The RefNG flag indicates that the reference position sensor 1 is abnormal. If the count RefM is not 8, the output of the reference position sensor 1 is abnormal, and at step 804 the RefNG flag is set. At step 805, the count A and count RefM are reset to 0 for the purpose of counting the output of the reference position signal Ref 1*a* occurring during the time in which the crank shaft is rotated twice, and the program advances to step 808.

At step 808, decision is made of whether the Ref NG flag is set. If it is not set, the reference position sensor 1 is normal. Thus, at step 809, the count Ref N is made 0 and the reference cylinder marked signal Mark A on line 4*a* is rendered low level. Then, the flow ends. As described above, the count RefN indicates the number of pulses of the reference position signal Ref 1*a* occurring in the interval of time from the leading edge and trailing edge of one cylinder discrimination signal Mark 3*a*. If the Ref NG flag is set, or when the reference position sensor 1 is abnormal, the output of the reference position 1 is not counted, but instead the output 2*a* of the angle sensor 2 is counted. Thus, at step 810, the count Pos Cn is made 0, and the reference cylinder signal Mark-A is rendered low level. Then, the flow ends. The count Pos Cn, as described later, indicates the number of outputs from the angle sensor 2 occurring in the interval from the leading edge to the trailing edge of the cylinder discrimination Mark. The count Pos Cn is stored in the counter set in the RAM 23.

Figure 9:
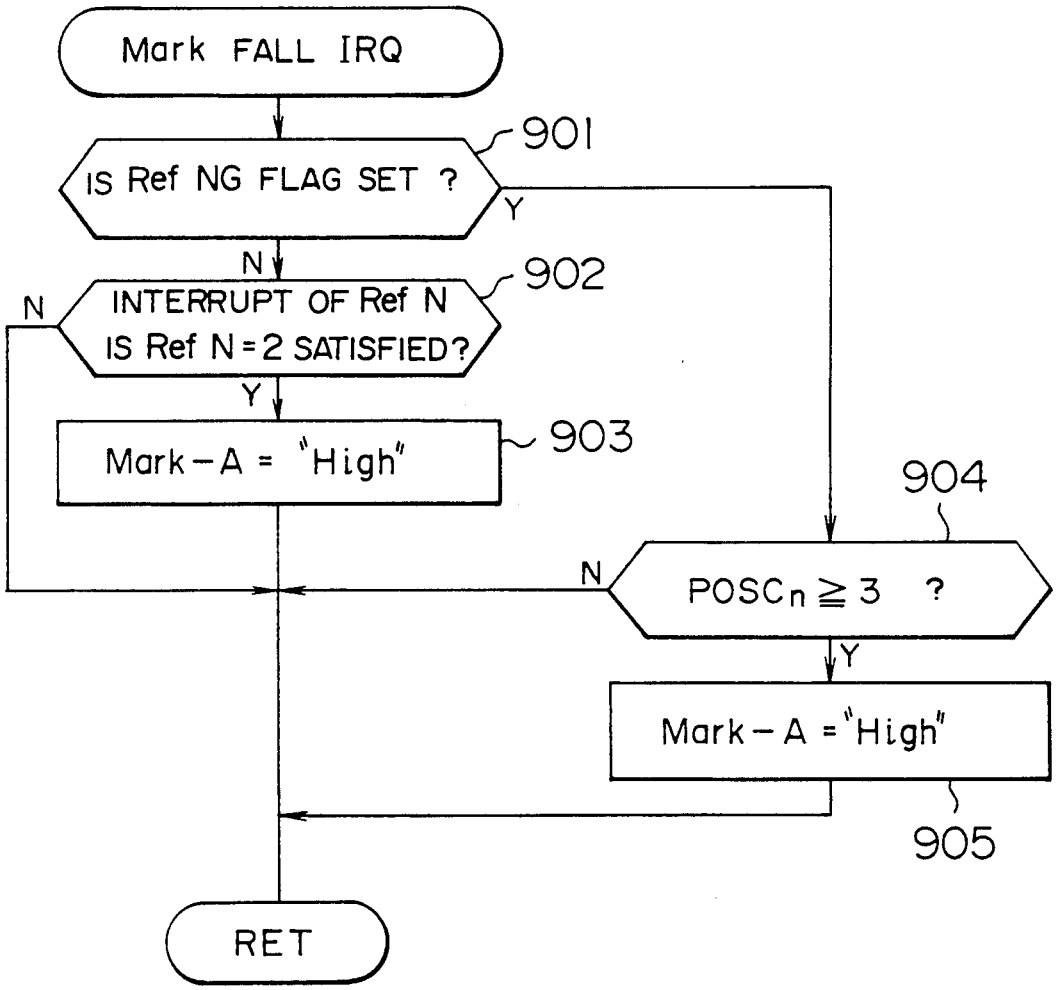

FIG. 9 is a flowchart showing the operation for the output of the reference cylinder signal Mark A on line 4*a* to distributor 24. The operation shown in the flowchart is started each time the cylinder discrimination signal Mark 3*a* falls off.

First, at step 901, a decision is made as to whether the Ref NG flag is set or not. If the Ref NG flag is not set, the reference position sensor 1 normally produces an output. The output pulse 1*a* from the reference position sensor 1 is used to decide whether the crank angle has reached the position in which the reference cylinder marked signal Mark A on line 4*a* occurs. Thus, at step 902, a decision is made as to whether the count Ref N is 2. This count Ref N indicates the number of pulses of the reference position signal Ref 1*a* occurring in the interval from the leading edge to the trailing edge of the cylinder discrimination signal Mark 3*a*. As shown in FIG. 2 when the crank angle has reached the position in which the reference cylinder signal marked Mark-A occurs, two pulses of the reference position signal Ref 1*a* are produced during the time in which the cylinder discrimination signal Mark 3*a* is high level. If the count Ref N is 2 at the trailing edge of the signal Mark 3*a*, the angle of the crank shaft is in the position in which the reference cylinder marked signal Mark-A occurs, and thus at step 903 the reference cylinder signal Mark A on line 4*a* is made high level. Then, the flow ends. If the count Ref N is not 2, the crank angle is not in the position in which the reference cylinder signal Mark A occurs on line 4*a*, and thus the flow ends.

On the other hand, if at step 901 the Ref NG flag is set indicating that the reference position sensor 1 is abnormal, the output 2*a* of the angle sensor 2 is used to decide whether the crank angle is in the position in which the reference cylinder marked signal Mark-A occurs. At step 904, decision is made of whether the count Pos Cn indicating the number of the angle signal Pos 2*a* produced in the interval from the leading edge to the trailing edge of the cylinder discrimination signal Mark 3*a* is larger than 3. As shown in the timing chart of FIG. 2, if the crank angle is in the position in which the reference cylinder marked signal Mark-A occurs, three or more pulses of the angle signal Pos 2*a* must be produced during the time in which the cylinder discrimination signal Mark 3*a* is produced. If the count Pos Cn is 3 or more, at step 905 the reference cylinder marked signal Mark A is made high level on line 4*a*, and the flow ends. If the count Pos Cn is not 3 or more, the flow ends.

Figure 10:
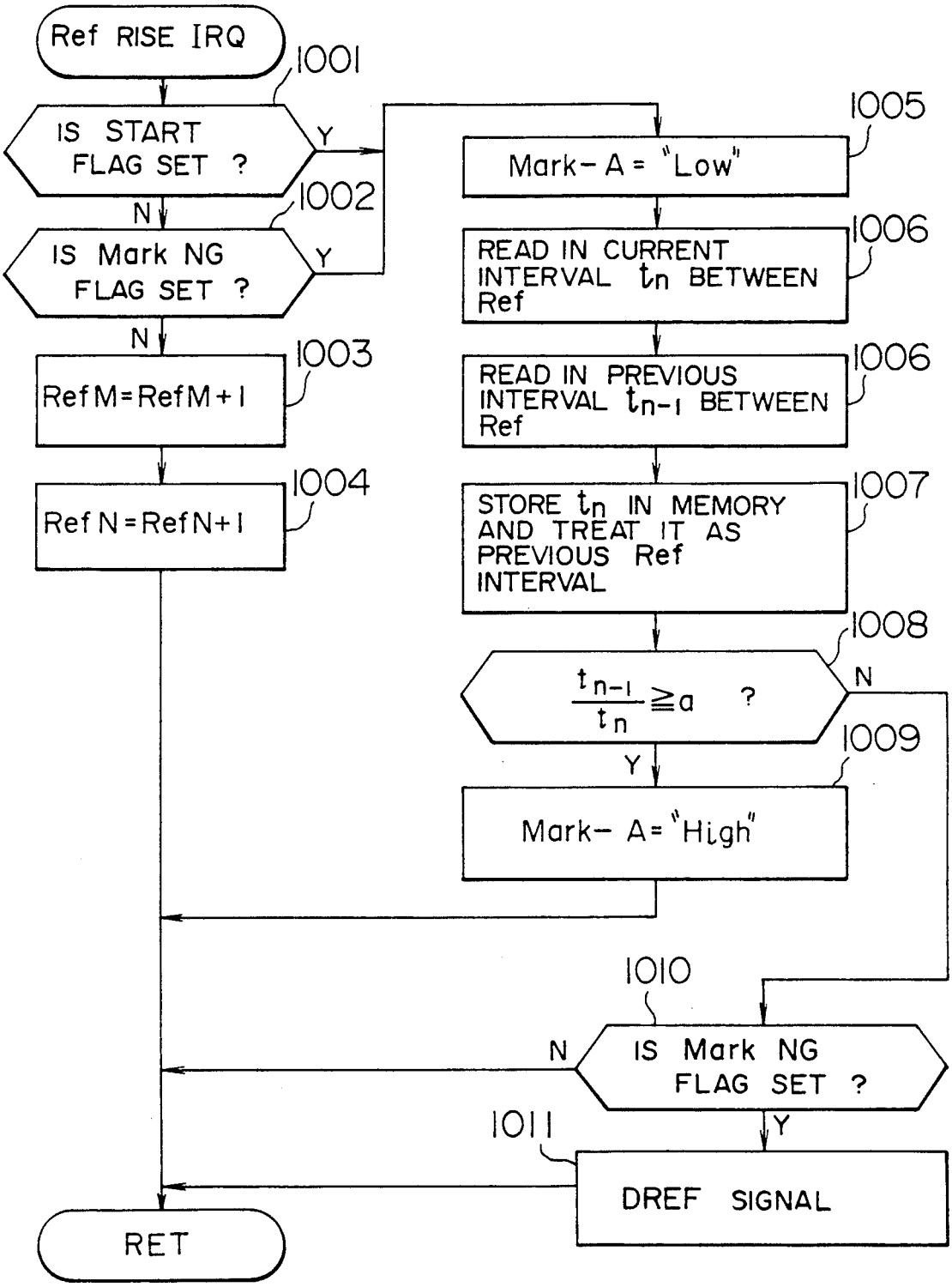

FIG. 10 is a flowchart showing the operation for the output of the reference cylinder marked signal Mark A on line 4*a* when the cylinder discrimination sensor 3 is abnormal and fails to operate. The operation shown in the flowchart is started each time the reference position signal Ref 1*a* rises. At step 1001, decision is made of whether the START flag is set or not. This START flag indicates the starting state, or that the ignition key is in the on-state. The START flag is set and reset by the detection of the output state of the start switch 5.

If at step 1001 the starting state is not brought about, and at step 1002 the output 3*a* of the cylinder discrimination sensor 3 is normal, at step 1003 the count Ref M of the reference position signal Ref 1*a* during the time in which the crank shaft is rotated twice is incremented by one. At step 1004, the count Ref N of the reference position signal Ref 1*a* during the time in which the cylinder discrimination signal Mark 3*a* is produced is incremented by one.

If at step 1001 the starting condition is brought about, or if at step 1002 the cylinder decision sensor 3 is abnormal, the program advances to step 1005 and the following steps for the simultaneous ignition of two cylinders based on the reference position signal Ref. At step 1005, the flag of the reference cylinder marked signal Mark-A is made low level. Then, the interval, $t_n$ between the pulses of the reference position signal Ref 1*a* of this time, which is counted by a hard counter, is read in. At step 1006, the interval, $t_{n-1}$ between the pulses of the previous reference position signal Ref 1*a* stored in a predetermined register of a memory is read in.

At step 1007, the interval $t_n$ between the pulses of the current reference position signal Ref for use in the case of the start of this flow is stored in a memory, then treated as the interval between the pulses of the previous reference position signal Ref for use in the case of the start flow.

At step 1008, the interval $t_{n-1}$ between the previous Ref pulses and the interval $t_n$ between the current Ref pulses are compared and decision is made as to whether the ratio is larger than a predetermined value "a" or not. As shown in the timing chart of FIG. 2, two pulses of the reference position signal Ref 1*a* continuously occur during the time in which the crank shaft is rotated once. Moreover, as shown in the timing chart, the two continuous pulses are produced in synchronism with the reference cylinder marked signal Mark-A. If at step 1008 $t_{n-1}/t_n \geqq a$, at step 1009 the "high" flag of the reference cylinder signal Mark-A is produced, and the flow ends. This reference cylinder marked signal Mark-A is produced each time the crank shaft is rotated once. As described above, this signal as shown in FIG. 5B is shifted in turn by a shift register so that the ignition signal is distributed. Thus, the ignition signal is supplied to two cylinders at a time.

At the time of cranking, no ignition signal is fed to the ignitor of each cylinder until the reference cylinder signal Mark-A is produced. Therefore, when only one pulse of the reference cylinder marked signal Mark-A is produced each time the crank shaft is rotated twice, in the worst case the ignition is not made at the time of starting until the crank shaft is almost rotated twice by a start motor. At step 1008, the reference cylinder marked signal Mark-A is produced each time the crank shaft is rotated once, so that two cylinders can be ignited at a time, thus improving the engine starting ability.

When the reference position signal Ref 1*a* does not successively occur, this reference position signal Ref 1*a* occurs at the leading edge of the cylinder discrimination signal Mark 3*a* as shown in the timing of FIG. 2. At step 1008, the DREF signal shown in the control circuit of FIG. 3 is produced when the cylinder discrimination signal Mark is produced, resetting each counter. Thus, when at step 1010 the cylinder discrimination sensor 3 is abnormal, at step 1011 the DREF signal is produced. If at step 1010 the Mark NG flag does not indicate that the cylinder discrimination sensor 3 is abnormal, the flow ends.

This invention is not limited to the 4-cycle/ 6-cylinder engine in the above embodiment. According to those skilled in the art, this invention may be applied to two-cycle engines and other engines having a different number of cylinders on the basis of the above disclosure.

According to this invention, even when the cylinder discrimination sensor is abnormal, the reference cylinder signal can be produced on the basis of the output of the reference position sensor. Therefore, since the backup for the abnormal operation can be made without the provision of the rotation sensor for a new backup, the cost of the whole ignition timing control system can be reduced.

We claim:

1. An engine ignition timing control system comprising:

first signal generating means for generating first signals at intervals of a predetermined crank angle while an engine is rotated n times, said first signals including a marked signal identifying a particular cylinder each time said engine is rotated n times;

second signal generating means for generating a number of second signals equal to the number of all cylinders of said engine at intervals of substantially an equal crank angle in synchronism with said first signals, said second signals including a reference signal having a form which is distinguishable from other second signals and which occurs in synchronism with said marked signal;

means for producing ignition signals in response to said first signals;

distributing means responsive to at least said reference signal for distributing an ignition signal to each cylinder in a predetermined ignition order;

means for detecting an abnormal condition of said first signals; and means for controlling said ignition signal producing means in response to said detecting means for producing said ignition signals in response to said second signals in place of said first signals when said abnormal condition of said first signals is detected.

2. An ignition timing control system according to claim 1, wherein said means for detecting the abnormal condition of said first signal includes means for counting a time elapsed from the start of said engine, and means for deciding that said first signal is abnormal if no first signal is produced during an interval in which said counting means has counted to a predetermined number.

3. An ignition timing control system according to claim 1, wherein said reference signal of said second signals comprises at least two successive pulse signals in synchronism with said marked signal.

4. An ignition timing control system according to claim 1, wherein said first signal generating means has means for generating pulse signals as said first signals, said means generating pulse signals as said marked signals which are wider than other first signals.

5. A ignition timing control system according to claim 1, wherein said ignition timing control system further includes third signal generating means for producing a third signal at intervals of a predetermined crank rotation angle of said engine, means for detecting the abnormal condition of said second signal, and means for detecting the synchronising position of said marked signal on the basis of said third signal in place of said second signal when an abnormal condition of said second signal is detected.

6. An ignition timing control system according to claim 5, wherein said means for detecting the abnormal condition of said second signal includes means for counting the number of pulses in said second signal during the time period in which said engine is rotated n times, and means for deciding that said second signal is abnormal when said counting means does not count a predetermined number during said time period.

7. An ignition timing control system according to claim 6, wherein said means for detecting said synchronising position includes means for detecting when a predetermined number or more of said third signals occur between the output pulses of said first signal as an indication the synchronizing position of said marked signal.

8. An ignition timing control system according to any one of claims 1 to 7, wherein said engine is a 4-cycle spark ignition engine, said first signal detecting means includes a sensor which produces a pulse at a crank rotation angle corresponding to a predetermined piston position of each cylinder, and n is 2.

9. An engine ignition timing control system according to claim 1, wherein said distributing means is responsive to both said reference signal and said marked signal for distributing said ignition signals, and wherein said controlling means is further responsive to said detecting means for controlling said distributing means solely in response to said second signals when said abnormal condition of said first signals is detected.

10. An engine ignition timing control system according to claim 1, wherein said distributing means includes a shift register having a number of stages corresponding respectively to the cylinders of the engine and a plurality of gates each coupled to a respective stage of said shift register for supplying an ignition signal to a respective cylinder, said shift register being connected to receive said ignition signals and a control signal responsive to at least said second signals.

11. An engine ignition timing control system according to claim 10, wherein said control means includes first means for generating said control signal in response to said reference signal and said marked signal when said detecting means indicates a normal condition of said first signals, and second means for generating said control signal solely in response to said reference signal when said detecting means indicates an abnormal condition of said first signals.

12. An engine ignition timing control system according to claim 11, wherein said first means generates said control signal when said marked signal is identified in said first signals by detecting said reference signal in said second signals.

13. An engine ignition timing control system according to claim 11, wherein said reference signal of said second signals comprises at least two successive pulse signals in synchronism with said marked signal.

14. An engine ignition timing control system according to claim 13, wherein said second means generates said control signal when said reference signal is detected from the interval between said second signals.

* * * * *